United States Patent [19]

Place

[11] Patent Number: 4,495,389

[45] Date of Patent: Jan. 22, 1985

[54] PRESSURE SWITCH

[75] Inventor: Donald E. Place, Mansfield, Ohio

[73] Assignee: Therm-O-Disc, Incorporated, Mansfield, Ohio

[21] Appl. No.: 387,287

[22] Filed: Jun. 11, 1982

[51] Int. Cl.[3] ..... H01H 35/34

[52] U.S. Cl. ..... 200/83 P

[58] Field of Search ..... 200/82 C, 83 R, 83 B, 200/83 A, 83 J, 83 P, 83 T, 83 W

[56] References Cited

U.S. PATENT DOCUMENTS

| | | | |
|---|---|---|---|
| 2,327,069 | 8/1943 | Sutterlee | 200/83 P |
| 3,261,958 | 7/1966 | Bittner | 200/82 C X |
| 3,335,242 | 8/1967 | Johnson | 200/83 T |
| 3,444,341 | 5/1969 | Mighton | 200/82 C |
| 4,121,073 | 10/1978 | Bileski et al. | 200/83 P |
| 4,121,074 | 10/1978 | Orcutt et al. | 200/83 P |
| 4,145,588 | 3/1979 | Orcutt | 200/83 P |

*Primary Examiner*—J. R. Scott

*Attorney, Agent, or Firm*—Pearne, Gordon, Sessions, McCoy, Granger & Tilberry

[57] ABSTRACT

A snap-disc-actuated switch for monitoring high fluid pressures is disclosed. A non-bistable snap disc, calibrated to snap from its stable state upon application of a relatively low force, is engaged at its center by one end of a pistonlike plunger having its other end exposed to a highly pressurized fluid. The effective cross-sectional area of the fluid-exposed end of the plunger is minimized to provide, in response to relatively high fluid pressure, the required low operating force directly to the snap disc via the plunger, the diameter of the plunger's exposed end being substantially less than the diameter of the disc. The force generated by the disc, when automatically resetting to its normal stable state, constitutes the sole means for moving the piston against the pressurized fluid-generated force acting on the exposed end of the piston.

7 Claims, 5 Drawing Figures

PRESSURE SWITCH

BACKGROUND OF THE INVENTION

The present invention relates in general to electrical switches, and more particularly to a novel and improved pressure-actuated switch suitable for use in relatively high pressure applications, such as in a hydraulic power steering system.

It is known in the art to use a snap-disc-actuated switch for monitoring fluid pressures. U.S. Pat. Nos. 3,335,242; 4,121,073; 4,121,074; and 4,145,588 all disclose a switch for such use wherein the pressurized fluid impinges directly on the snap disc over the extent of its fluid-exposed surface area.

Optimum operating and structural characteristics of a conventional snap disc of the type under consideration require that the disc snap from its stable state position of first curvature to its opposite position of curvature, which is the switch-actuating state, at a relatively low applied force, e.g., 10 lbs. To monitor a relatively high fluid pressure, e.g., 550 psi, in accordance with the teaching of the noted patents, supra, it would be necessary to provide a very stiff disc having a very high operating force. Because it is impractical to accurately provide such a stiff disc, disc devices of these patents have been limited in their use to the monitoring of relatively low pressures.

In one aspect, the present invention provides a snap-disc-actuated switch for monitoring high fluid pressures, such a switch utilizing a low-force-actuated snap disc of conventional design.

In a further aspect, the present invention provides a high-pressure-actuated snap disc switch that is reliable, simple in construction, and low in manufacturing cost.

SUMMARY OF THE INVENTION

In accordance with the present invention, a pressure-actuated snap disc is calibrated to snap from a stable state to its position of opposite curvature upon application of a relatively low first force and to return to its stable position when the applied force is reduced to a second lower force. The disc is engaged by one end of a pistonlike plunger having its other end exposable to a highly pressurized fluid. The effective cross-sectional area of the exposed end of the plunger is minimized to provide, in response to relatively high fluid pressure, the required low operating force directly to the disc via the plunger. Seal means, preferably of the elastomeric type, are used to isolate the disc from the pressurized fluid so as to preclude the application of fluid pressure-generated forces to the disc by means other than the plunger. The interface area of the piston end and the snap disc is vented to ensure that only the pistonlike plunger applies force to the plunger-engaged side of the disc. In accordance with the invention, a low-force-operative disc of conventional design can be utilized to monitor relatively high fluid pressures, this invention resulting in a highly reliable pressure-actuated switch of simple design and low cost.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENTS

Figure 1:
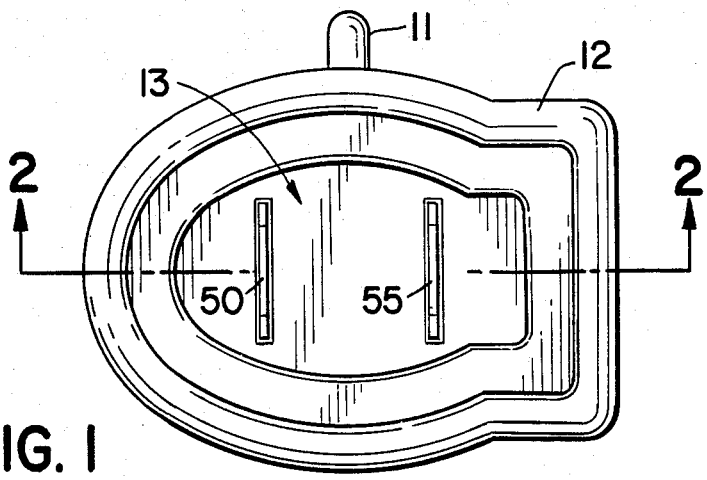
FIG. 1 is a top plan view of a pressure-actuated snap disc switch in accordance with the present invention.
Figure 2:
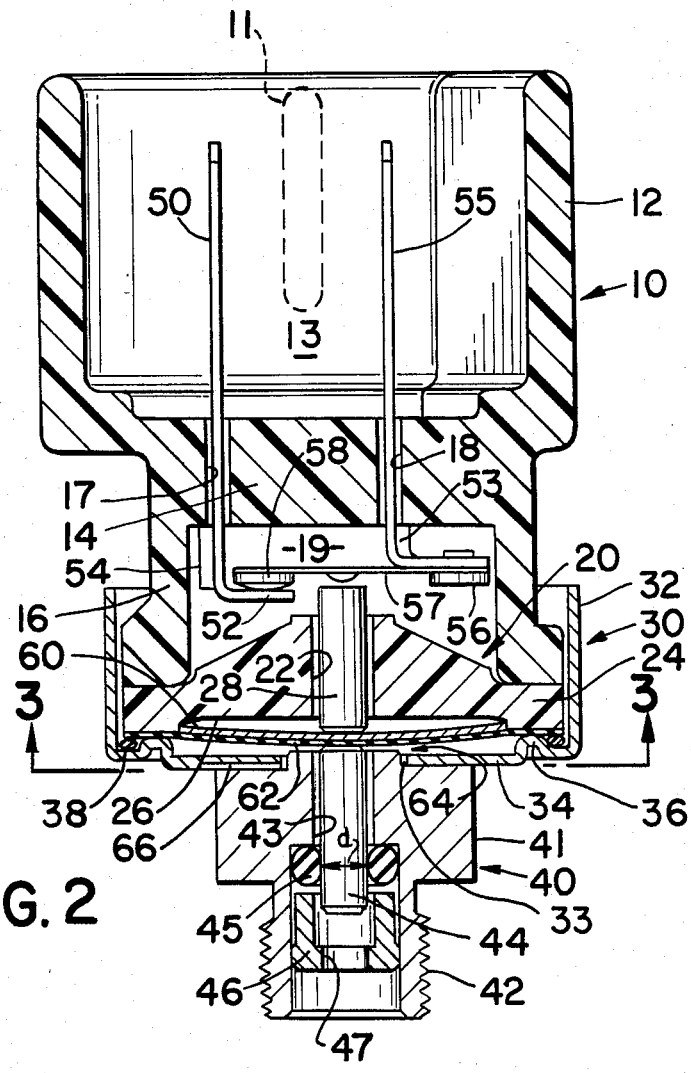
FIG. 2 is an elevation view in cross section along line 2—2 of the pressure-actuated snap disc switch illustrated in FIG. 1.

With reference to FIGS. 1 and 2, there is illustrated a snap-disc-actuated switch for monitoring high fluid pressures in accordance with the teachings of the present invention.

Such a switch includes a multipart casing comprised of a switch housing 10, a bumper pin guide 20, a snap-disc-enclosing cup 30, and a plunger guide 40. These four parts 10, 20, 30, 40 interconnect to provide the external surfaces of the switch of the present invention, such parts further providing internal chambers for enclosing and supporting elements to be subsequently illustrated and described.

The switch housing 10 of the casing includes a continuous upper wall portion 12 and a continuous lower wall portion 16, such portions 12, 16 extending in opposite directions in perpendicular fashion from an intermediate section 14. The intermediate section 14 and the continuous upper wall portion 12 define a terminal recess 13 in the top of the switch casing. Extending outwardly from a point on the outer surface of the upper wall portion 12 is a detent means 11 which will lockably engage a clip portion of a female-type socket connector (not shown) pushed into the recess 13 to electrically connect with the switch in a manner to be subsequently discussed. As viewed in FIG. 1, the actual configuration of the recess 13 defined by the wall 12 is dependent upon the application of the switch. The configuration illustrated in FIG. 1 is utilized in an automobile power steering system of conventional type. It is to be noted that the configuration of the wall 12, the volume of the recess 13, and the shape of the detent 11 can take other suitable forms for different switch applications without departing from the scope of the invention disclosed and claimed herein.

The bumper pin guide 20 is circular in shape and has its outer periphery 24 in contiguous engagement with the lower end surface of the continuous lower wall portion 16 of the switch housing 10. The central portion of the bumper pin guide 20 is spaced from the intermediate section 14 of the switch housing portion 10 to define a switch contact chamber 19 containing electrical switch means, to be discussed.

The bumper pin guide 20 of the switch casing is held in position against the lower end of the switch housing 10 by the snap-disc-enclosing cup 30, in which the bumper pin guide 20 and the lower end of the continuous lower wall portion 16 are nested and retained. The cup 30 includes an outer wall section 32 and a floor 34. Extending downwardly from the floor 34 of the snap-disc-enclosing cup 30 is the plunger guide 40. The outer wall section 32 of the cup 30 encloses the interface area between the bumper pin guide 20 and the lower end of the continuous lower wall portion 16. The casing parts 10, 20, 30, 40 are held in position relative to each other by suitable fastening means well known in the art, such as welding, crimping, and/or adhesive bonding.

The intermediate section 14 of the switch housing 10 of the casing provides a pair of spaced, parallel extending apertures defined by aperture-defining walls 17, 18. Mounted and positioned immediately below the intermediate section 14, as illustrated in FIG. 2, is a switch means including a fixed contact means and a movable contact means. The fixed contact means includes a conductive metal terminal portion 50 that extends from a point external of the casing and within the recess 13 through the aperture 17. The lower end of the terminal portion 50 of the fixed contact means is bent to provide, extending perpendicularly from it, a fixed contact section 52. A positioning tang or flange 54, constituting an integral part of the terminal portion 50, spaces the fixed contact section 52 a proper distance from the lower surface of the intermediate section 14 of the switch housing 10. A terminal portion 55 of the movable contact means extends externally of the casing, and is located in the recess 13, wherein the terminal portions 50,55 are parallel to each other and generally identically shaped and configured for electrical and mechanical engagement with a socket connector of the female type (not shown) that plugs into the recess 13, as discussed earlier. In a manner similar to that of the fixed contact means discussed earlier, the terminal portion 55 of the movable contact means is bent to provide at its lower end a perpendicularly extending portion providing a rivet 56 that connects the terminal portion 55 to one end of a resilient switching arm 57 having its distal or free end carrying a movable contact button 58 that is engageable with the fixed contact section 52, the arm 57 and button 58 comprising the movable elements of the switch means. A movable contact tang or flange 53 functions in a manner similar to flange 54 to properly position the arm 57 and button 58 of the movable contact means relative to the fixed contact means and to the intermediate section 14. The switching arm 57 is movable and bendable relative to its fixed end secured in position by the rivet 56, movement of the arm 57 electrically engaging and disengaging the contact button 58 with the fixed contact section 52. Such a configuration provides a single throw, single-pole electrical switch that can be used to make and break a circuit externally connected via the terminal portions 50,55. Other switch configurations, such as a double-throw, single-pole configuration, are also contemplated within the scope of the invention.

To move the resilient switching arm 57, a linearly slidable bumper pin 28, of cylindrical shape and having flat, parallel ends, constitutes a motion transfer element received for longitudinal reciprocating movement in a center aperture or through bore of the bumper pin guide 20, such bore being defined by a wall 22. The bumper pin 28, when moving upwardly as viewed in FIG. 2, will strike and engage the resilient switching arm 57 to move it upwardly and to thus pull the contact button 58 upwardly away from the fixed contact 52 to open circuit the switch means. Lowering of the bumper pin 28 will, at a certain point, cause the upper end of the pin 28 to disengage from the resilient arm 57, wherein such arm 57 provides a biasing force for holding the contact 58 in contiguous relationship with the contact 52, wherein the circuit connected to the switch will be in a closed condition. Thus, the switch means illustrated is normally closed; however, it is to be noted that a normally open switch could be provided without departing from the scope of the invention.

The lower end of the bumper pin 28 rests upon and is supported by the center portion of a non-bistable, metal snap disc 60 of concave configuration. The snap disc 60 is of a conventional low-force-actuated type and will, for example, switch from a stable state of a first curvature, as illustrated in FIG. 2, to a non-stable state of opposite curvature upon the application of a force of a first predetermined value, for example, 10 pounds of force, to the middle portion of its lower surface. In snapping from the concave state illustrated in FIG. 2 to a non-stable reverse concave state, wherein the bumper pin 28 is driven upwardly to open the switch means, the disc 60 will maintain its position at such non-stable state until the snapping force applied against it is reduced to a force of a second predetermined value lower than such first predetermined value, wherein it will snap back to and automatically reset to its normal stable state as illustrated in FIG. 2. The non-bistable, low-force-operative disc 60 is of a construction well known in the art.

The disc 60 is loosely retained at its periphery within a chamber defined by a disc recess wall 26 of bumper pin guide 20 and a flexible, relatively thin, imperforate elastomeric diaphragm 62. The diaphragm 62, having the stable state disc 60 supported by and resting upon it as illustrated in FIG. 2, is circular in shape, having its outer periphery held in position against the lower peripheral flange portion 24 of the guide. Such holding of the diaphragm 62 in position is accomplished by a raised retaining lip 36 about the outer periphery of the floor 34 of the snap-disc-enclosing cup 30. A large diameter, O-ring type, elastomeric seal 38 ensures a fluidtight relationship between the cup 30 and the bumper pin guide 20. The diaphragm 62, in addition to serving as a simple means for loosely retaining the disc 60 in position, seals and isolates, in protective fashion, the disc 60, bumper pin 28, and switch elements in chamber 19 from fluids impinging on the underside of the diaphragm 62 (as viewed in FIG. 2). It is desirable that the disc be loosely retained within the switch casing to operate in a reliable and predictable manner.

In accordance with the present invention, the central portion of the low-force-actuated disc 60 is engaged and driven to its non-stable state by a pistonlike plunger 44, in the preferred form of a cylindrical pin having flat, parallel ends, the plunger 44 slidably riding in a bushinglike center bore defined by a wall 43 provided by the plunger guide 40. The plunger guide 40 is formed of metal and includes an upper cup-engaging section 41 that is fastened to the underside of the floor 34 of the cup 30 by suitable means, such as spot welding, the cup being formed of stamped sheet metal, for example. A central aperture 33 in the floor 34 provides disc access means wherein the pistonlike plunger 44 can extend upwardly to drivingly engage the disc 60, the thin diaphragm 62 being positioned between the disc 60 and the upper end of the pistonlike plunger 44.

The plunger guide portion 40 further includes a threaded coupling portion 42 that is engageable with elements enclosing and confining pressurized fluid. The threaded coupling portion 42 is annular in shape and receives a retainer 46 press-fitted therein to maintain in position an elastomeric seal 45 that engages in fluidtight relation an axial portion of the plunger 44. The lower end of the plunger 44 as viewed in FIG. 2 is exposable to pressurized fluid via an aperture defined by a wall section 47 provided by the retainer 46. The aperture defined by the wall 47 is circular and has a diameter slightly less than the diameter of the plunger 44. Thus, the plunger 44 is limited in its downward movement by the retainer 46, which acts as a stop, the seal 45 also being held in position relative to the plunger 44 to preclude the migration of pressurized fluid along the plunger 44 towards the disc 60.

The diameter d of the plunger 44 is selected so that the proper force required to operate the disc 60 is produced when the plunger is exposed to the desired operating pressure. Similarly, the disc is calibrated so that the second predetermined force at which resetting automatically occurs has the proper value required to move the plunger back against the fluid pressure when the desired reset pressure is reached. It should also be noted that the frictional engagement between the plunger 44 and the seal 45 resists movement of the plunger 44 in both directions.

If it is assumed that switch operation is required when the plunger is exposed to 550 psi and the frictional drag of the seal 45 on the plunger 44 is 0.6 pounds, the operating force of the disc is determined as follows:

$$\text{Disc force required} = (550)\ (\text{plunger area}) - 0.6$$

If the plunger has a diameter of 0.125 inch, then:

$$\text{Disc force required} = (550) \times \left(\frac{0.125^2\pi}{4}\right) - 0.6$$

$$= 6.150 \text{ pounds.}$$

Since a disc having such a low operating force value is easily manufactured, a device having such operating characteristics is completely practical.

Figure 3:
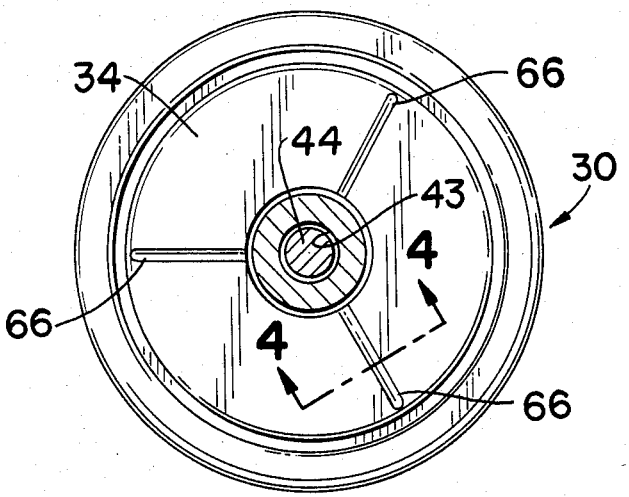
FIG. 3 is a bottom plan view in cross section along line 3—3 of FIG. 2.
Figure 4:
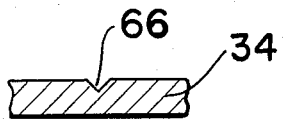
FIG. 4 is an enlarged cross section view, with portions cut away, taken along line 4—4 of FIG. 3.

To ensure that only the plunger 44 applies a snapping force to the disc 60, a venting means in the preferred form of vent grooves 66, illustrated most clearly in FIG. 3, are provided in the lower surface of the floor portion 34 of the cup so as to vent to ambient any fluid pressure that would build up at the interface area 64 between the upper end of the plunger 44 and the disc 60, the imperforate flexible diaphragm 62 isolating the disc 60 from any leaked fluid that might be present. For example, if the seal 45 should fail to a limited degree, some pressurized fluid might leak past the seal and migrate upwardly along the plunger 44 into the interface area 64. To preclude such migrating fluid from building up to a point of applying pressure against the disc 60 via the diaphragm 62, the fluid is vented via the grooves 66, thus ensuring that the disc only responds to the action of fluid pressure on the exposed lower end of the plunger 44.

In accordance with the present invention, the piston-like plunger 44 has its one end or upper end (as viewed in FIG. 2) engageably driving the relatively large diameter disc, while the other end of the plunger having a relatively small diameter is exposable to a highly pressurized fluid. The effective cross-sectional area (at diameter d) of the exposed end of the plunger is minimized by design to provide, in response to relatively high fluid pressures, the required low operating force directly to the substantially larger surface area snap disc 60 via the plunger 44.

Further, the seal means in the preferred illustrated form of the elastomeric seal 45 surrounds and engages an axial portion of the plunger 44 to preclude response of the disc 60 to pressurized fluid that might migrate along the plunger toward the disc, the vent groove 66 further precluding such disc response should, for some reason, pressurized fluid enter the interface area 64 between the upper end of the plunger 44 and the disc 60.

The operation of the switch illustrated in accordance with the present invention, will now be discussed in further detail. As the pressure of fluid on the exposed lower end of the plunger 44 increases, the plunger 44 slidably moves upwardly and applies a snapping force to the disc 60, wherein at a predetermined force, the disc 60 will rapidly snap to an opposite, concave configuration of that shown in FIG. 2. The snapping of the disc 60 will in turn drive the bumper pin 28 upwardly into engagement with the resilient arm 57. It is to be noted that the bumper pin 28 is of a length slightly less than the distance between the disc 60 in its stable state and the switch arm 57 in its closed position, such dimensioning providing for a lost motion increment of bumper pin movement, as is well known in the art, to cause rapid accelerated movement of the button 58 away from the contact section 52, wherein creeping action of the switch contact portions 52,58 relative to each other is precluded. If the pressure of the monitored fluid remains at a level in excess of the predetermined pressure required to snap the disc 60 and open the switch means, the disc 60 will remain in position at its unstable state to hold the switch open. As the pressure of the monitored fluid decreases, the disc 60 will eventually reach a condition where it will automatically reset to the position illustrated in FIG. 2, such resetting of the disc 60 driving the plunger 44 downwardly against the force of the pressurized fluid, the disc 60 acting as the sole means for resetting the piston to the position illustrated in FIG. 2, the force of the resilient arm 57 against the bumper pin 28 being negligible.

In designing a switch in accordance with the present invention, the plunger 44 is preferably a ground metal pin of cylindrical shape having flat, parallel ends, the bumper pin 28 being of similar structure, wherein the pin 28 and the plunger 44 extend in perpendicular directions from opposite sides of the central portion of the disc 66 along a common axis. Further, the diameter of the plunger 44 is initially decided upon and then the disc 60 is designed to have a prescribed operating force for monitoring a particular fluid pressure level. As noted earlier, in designing the disc 60, it is necessary to take into account not only the diameter of the plunger 44 and the fluid pressure to be monitored, but also the frictional drag (resistive force) that the seal 45 will have on the movement of the plunger 44.

Figure 5:
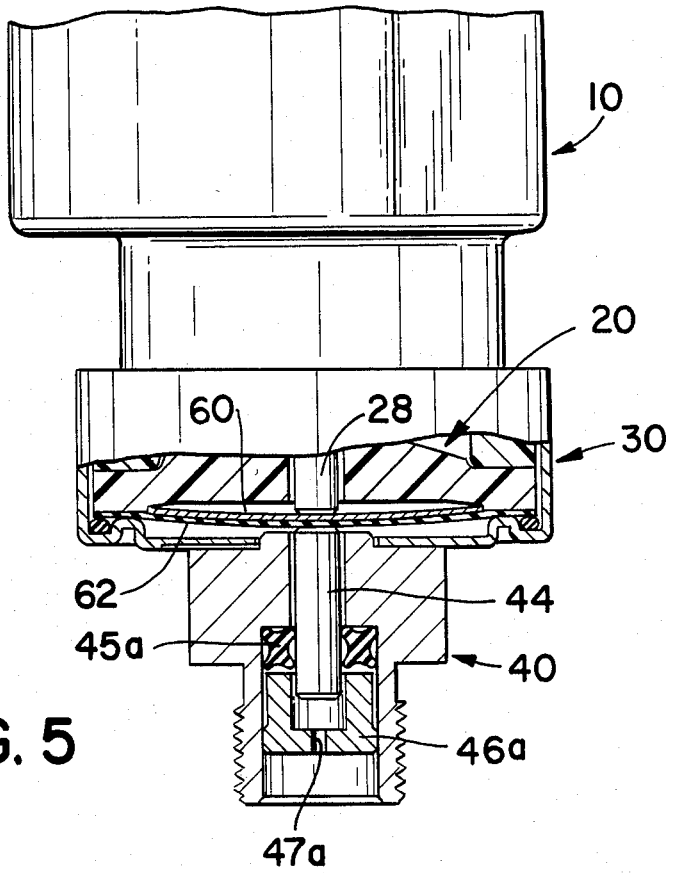
FIG. 5 is an elevation view, with portions cut away, of another embodiment of a switch in accordance with the invention.

With reference to FIG. 5, there is illustrated another preferred embodiment of the present invention, wherein the switch is of identical design to that illustrated and discussed with regard to FIGS. 1 through 4, but for the provision of a multilobed, elastomeric seal 45*a* held in position by a modified retainer 46*a* having a fluid inlet aperture, defined by walls 47*a*, of a diameter smaller than the fluid inlet diameter illustrated in FIG. 2. The seal 45*a* offers, at higher cost, known advantages (lower frictional drag, redundant sealing) over the plain O-ring type seal illustrated in FIG. 2. Further, the orifice defined by wall 47*a* in FIG. 5 is considerably smaller than that necessary to simply retain the plunger 44 in position, as was the function of the retainer 46 discussed earlier with regard to FIG. 2. The fluid inlet aperture or orifice defined by circular wall 47*a* further functions to act as a dampening orifice means to preclude operation of the switch where rapid but transient upward fluctuations in pressure of the monitored fluid may occur. By adjusting the size of the orifice like aperture defined by wall 47, the switch in accordance with the invention can be designed to have different dynamic response characteristics.

The present invention provides the adaptation of a low-force-actuated conventional non-bistable snap disc to the monitoring of relatively high fluid pressures. Switches in accordance with the invention have been found to be highly reliable and, since they are of simple construction, are relatively inexpensive to manufacture.

Although the preferred embodiments of this invention have been shown and described, it should be understood that various modifications and rearrangements of the parts may be resorted to without departing from the scope of the invention as disclosed and claimed herein.

What is claimed is:

1. A fluid pressure monitoring snap disc switch comprising:

a casing;

a switch means mounted on the casing and including a fixed contact and a movable contact engageable with the fixed contact;

a snap disc supported at its periphery by the casing;

a movable motion transfer element, slidably supported by the casing for reciprocating movement, and extending between the central portion of one side of the disc and the movable contact, snap movements of the central portion of the disc causing concurrent movements of the movable contact via the motion transfer element, the disc being calibrated to snap from a stable state upon application of a relatively low force;

a pistonlike plunger slidably supported by the casing for linear reciprocating movement on its longitudinal axis, one end of the plunger engaging the central portion of the other side of the disc, the other end of the plunger being exposable to a highly pressurized fluid, the effective cross-sectional area of the exposed end of the plunger being minimized to provide, in response to relatively high fluid pressure, the required low operating force directly to the snap disc via the plunger; and seal means mounted on the casing and slidably engaging the plunger to preclude the application of fluid-pressure-generated forces to the disc by means other than the plunger, the disc being a non-bistable snap disc having a stable state and a non-stable state, movement of the plunger toward the disc applying a force to the disc to snap it from its stable state to its non-stable state, a predetermined decrease in the applied force allowing the disc to automatically reset from its non-stable state to its stable state, said resetting disc being the sole means for moving the piston against the high fluid pressure-generated force acting on the exposed end of the piston.

2. A switch according to claim 1, wherein said means mounted on the casing includes an elastomeric seal engaging and surrounding an axial portion of the plunger, the elastomeric seal being in fluidtight relationship with both the plunger axial portion and adjacent portions of the casing slidably supporting the plunger, wherein highly pressurized fluid is precluded by the seal from acting directly on the disc, the seal stopping the flow of fluid from the exposed end of the plunger toward the end of the plunger engaging the disc.

3. A switch according to claim 1, including means provided by said casing for venting the general interface area of the plunger and diaphragm to preclude a pressure buildup against that side of the disc engaging the plunger by means other than mechanical force applied to the disc by the plunger.

4. In a fluid pressure monitoring switch having a housing containing a pressure-actuated snap disc calibrated to snap from a stable state upon application of a relatively low force, means for adapting such a low force operative disc to the monitoring of high pressure fluid-generated forces comprising:

an axially movable pistonlike plunger having one end engageable with one side of the disc, the other end of the plunger being exposable to a highly pressurized fluid, wherein the effective cross-sectional area of the exposed end of the plunger is minimized to provide, in response to relatively high fluid pressure, the required low operating force directly to the snap disc via the plunger when said plunger moves toward said disc as a result of the force generated on said exposed end of said movable plunger by said pressurized fluid, said switch including fluidtight seal means mounted on said housing, and surrounding and engaging an axial portion of the plunger to preclude pressurized fluid migration along the plunger toward the disc, the area of the disc being substantially greater than said cross-sectional area of the exposed other end of said plunger, the disc being a non-bistable snap disc having a stable state and a nonstable state, movement of the plunger toward the disc applying a force to the disc to snap it from its stable state to its non-stable state, a predetermined decrease in the applied force allowing the disc to automatically reset from its nonstable state to its stable state, said resetting disc being the sole means for moving the piston against the high fluid pressure-generated force acting on the exposed end of the piston.

5. A fluid pressure monitoring snap disc switch comprising:

a casing;

a switch means mounted on the casing and including a fixed contact and a movable contact engageable with the fixed contact;

a snap disc supported at its periphery by the casing, the snap disc being of the non-bistable type having a stable state and an unstable state, the switch means being located to one side of the disc wherein the central portion of the disc is closest to the switch means when the disc is held at its unstable state;

a motion transfer bumper pin slidably supported by the casing for linear reciprocating movement on its longitudinal axis and extending between the central portion of said one side of the disc to the movable contact, snap movements of the central portion of the disc causing concurrent movements of the movable contact via the bumper pin, the disc being calibrated to snap from its stable state upon application of a relatively low force;

a pistonlike plunger of longitudinal cylindrical shape having a constant diameter and flat, parallel ends and being slidably supported by the casing for linear reciprocating movement on its longitudinal axis, one end of the plunger engaging the central portion of the other side of the disc, the other end of the plunger being exposable to a highly pressurized fluid, the effective cross-sectional area of the exposed end of the plunger being minimized to provide, in response to relatively high fluid pressure, the required low operating force directly to the snap disc via the plunger;

an O-ring type elastomeric seal surrounding and engaging in fluidtight relationship an axial portion of the plunger, the seal further engaging in fluidtight relationship adjacent portions of the casing slidably supporting the plunger wherein fluid movement between the casing and the plunger from the exposed end of the plunger toward the disc is precluded;

a thin, imperforate, flexible diaphragm sandwiched between the disc and the end of the plunger engaging the disc, the diaphragm isolating the disc, bumper pin, and switch from fluid in the area adjacent that side of the diaphragm in contiguous relationship with the plunger end engaging the disc; and means for venting said area adjacent that side of the diaphragm in contiguous relationship with the plunger end engaging the disc, the disc being a non-bistable snap disc having a stable state and a non-stable state, movement of the plunger toward the disc applying a force to the disc to snap it from its stable state to its non-stable state, a predetermined decrease in the applied force allowing the disc to automatically reset from its non-stable state to its stable state, said resetting disc being the sole means for moving the piston against the high fluid pressure-generated force acting on the exposed end of the piston.

6. A switch according to claim 5, wherein the diaphragm loosely retains the peripheral edge of the disc in position relative to the casing, the edge of the diaphragm being fixed to the casing.

7. A switch according to claim 5, wherein the longitudinal axis of the plunger and the bumper pin are located on a common axis located at the center of the disc and extending generally perpendicular thereto to both sides of the disc, wherein the central portion of the disc, the bumper pin, and the plunger move together in reciprocating fashion along said common axis in response to fluctuation in the pressure differential between the pressure-affected areas of the ends of the plunger.

* * * * *